US006517422B2

(12) United States Patent
Sakamoto et al.

(10) Patent No.: US 6,517,422 B2
(45) Date of Patent: Feb. 11, 2003

(54) POLISHING APPARATUS AND METHOD THEREOF

(75) Inventors: Takao Sakamoto, Niigata (JP); Shinya Kawamoto, Niigata (JP); Katsuaki Kotari, Niigata (JP); Katsuyoshi Kojima, Niigata (JP); Masayoshi Saitou, Niigata (JP); Yoshihiko Hoshi, Niigata (JP)

(73) Assignee: Toshiba Ceramics Co., Ltd., Tokyo (JP)

( * ) Notice: Subject to any disclaimer, the term of this patent is extended or adjusted under 35 U.S.C. 154(b) by 0 days.

(21) Appl. No.: 09/798,980

(22) Filed: Mar. 6, 2001

(65) Prior Publication Data

US 2001/0027081 A1 Oct. 4, 2001

(30) Foreign Application Priority Data

Mar. 7, 2000 (JP) ..... 2000-062184
Mar. 31, 2000 (JP) ..... 2000-097204

(51) Int. Cl.[7] ..... B24B 29/00
(52) U.S. Cl. ..... 451/288; 451/398
(58) Field of Search ..... 451/285, 286, 451/287, 288, 291, 41, 398

(56) References Cited

U.S. PATENT DOCUMENTS 5,885,140 A * 3/1999 Hakomori ..... 451/72
5,916,412 A * 6/1999 Nakashiba et al. ..... 156/345
5,975,998 A * 11/1999 Olmstead ..... 451/288
6,027,398 A 2/2000 Numoto et al.

FOREIGN PATENT DOCUMENTS

JP 5-326468 12/1993
JP 11-114806 4/1999

* cited by examiner

*Primary Examiner*—George Nguyen
*Assistant Examiner*—Dung Van Nguyen
(74) *Attorney, Agent, or Firm*—Foley & Lardner

(57) ABSTRACT

A polishing apparatus which attaches the semi-conductor wafers 5 to the polishing plate 4 for performing the polishing as applying pressure the polishing cloth with the semi-conductor wafers, is provided with a guide ring 7 disposed outside of the polishing plate for pressing the polishing cloth separately from the polishing plate, a retainer ring 8 provided at the lower end of the guide ring for contacting the polishing cloth, and a weight 9 detachably mounted on the upper surface of the guide ring for adjusting the pressure to the polishing cloth.

8 Claims, 14 Drawing Sheets

POLISHING APPARATUS AND METHOD THEREOF

BACKGROUND OF THE INVENTION

1. Field of the Invention

The present invention relates to a polishing apparatus for polishing semi-conductor wafers evenly and in mirror-surface, and in particular to a polishing apparatus enabling to control polishing amount around peripheral parts of the semi-conductor wafer.

2. Description of the Related Art

In general, a semi-conductor wafer is subjected to a so-called mirror-face polishing process for providing a mirror face with flatness of high precision and without strain. For performing the mirror-face polishing process, generally plural sheets of the semi-conductor wafer are polished simultaneously, so-called batch type polishing apparatus is served. With respect to the batch type polishing apparatus, explanation will be made in reference to FIGS. 10 and 11 of the attached drawings.

As shown, this polishing apparatus is equipped with a rotary shaft 1*a*, a polishing level block 1 provided on the upper end of the rotary shaft 1*a*, a polishing cloth pasted on the upper surface of the polishing level block 1, a polishing head 3 disposed rotatably and movably vertically at a position eccentric from the rotary shaft 1*a*, a plurality of plate holders 6 provided on the outer periphery of the polishing head 3, and a polishing plate 4 attached to the lower surface of the polishing head 3 and to be positioned by the plate holder 6.

The semi-conductor wafer 5 are, as shown in FIG. 11, arranged in the circumferential direction of the polishing plate 4, and the plural sheets are pasted to the surface of the polishing plate 4.

For polishing the semi-conductor wafer 5 by means of this polishing apparatus, the polishing level block 1 is rotated in an arrow direction around the rotary shaft 3*a*, and at the same time the polishing head 3 at the eccentric position with respect to the polishing level block 1 is rotated in the arrow direction. Subsequently, as dropping a polishing liquid A from a center of the polishing cloth 2 (an upper part of the rotary shaft 1*a*), the polishing head 3 is moved down to cause the semi-conductor wafer 5 to press to the polishing cloth 2.

In this conventional polishing apparatus, for polishing, the polishing liquid A is, as seen in FIG. 10, poured to the center of the polishing cloth 2 and flows in the outer circumference of the polishing cloth 2. As a result, the polishing liquid is much supplied to the circumference of the polishing 5, so that the polishing is progressed more in the circumference of the semiconductor wafer 5 than the central part (inside part), so-called excessive polishing (sags) takes place.

With respect to sags caused at the circumferential part of the semiconductor wafer, JP-A-11-114806 proposes that there is furnished a polishing face adjusting ring encircling the outer circumference of one sheet of wafer, so that the pressing force of the polishing face adjusting ring is controlled by fluid pressure so as to exert uniform polishing force to the semi-conductor wafer for uniformly polishing the semi-conductor wafer.

PROBLEMS THAT THE INVENTION IS TO SOLVE

In the conventional polishing apparatus using the polishing face adjusting ring, the polishing face adjusting ring is pressed to the polishing cloth by fluid pressure and at the same time the pressure is controlled. As to the control of pressure by the fluid pressure, if the structure of the polishing apparatus is complicated, it is difficult to adjust pressure by the fluid pressure, and the pressure of the polishing face adjusting ring is varied as a time passes or depending on positions, and it is difficult to always effect pressure all over the ranges. In particular, in the batch type polishing apparatus where plural sheets of semi-conductor wafers are pasted on one sheet of plate for performing the polishings concurrently, the polishing face adjusting ring encircling the semi-conductor wafer is of large-diameter, and it is difficult to adjust all over pressing face of the polishing face adjusting ring and maintain the uniform force.

Even if the pressure is controlled by the polishing face adjusting ring to exert the uniform polishing force on the semi-conductor wafers, occurrences of sags could not be prevented and a substantial solution has not yet been realized.

Further, a semi-conductor wafer is made by producing a semi-conductor ingot of single crystal through, for example, a Czochralski method from polycrystal, slicing the ingot into predetermine thickness by means of such as a multi-wire sawyer, grinding the sliced semi-conductor wafer by a grinding apparatus, and further mirror-polishing it by a polishing apparatus.

But recently, accompanied with high integration of semi-conductor device, a demand has been arisen in the semi-conductor wafer as to the degree of flatness, and in the mirror-polishing process, a problem occurs about excessive polishing (outer circumferential sags) in the outer peripheral part of the semi-conductor wafer. It is assumed that one cause is owing to influences by sinking or depressing the abrasive cloth, and measures therefor have been practiced for moderating depression of the polishing cloth into the semi-conductor wafer by hardening the polishing cloth itself or previously pushing the polishing cloth.

For providing the polishing effect by the retainer ring, one of important factors is a distance (clearance) between the semi-conductor wafer and the retainer ring.

Namely, showing in FIGS. 21 and 22 as the results of simulating pressure dispersions of the retainer ring, the semi-conductor wafer and the polishing cloth by a static analysis, when the clearance C is large as shown in FIG. 21, since the polishing cloth 211 once crushed by the retainer ring 212 recovers until contacting the semi-conductor wafer 213 by compression elastic modulus of the polishing cloth 211, large change does not occur in pressure of the peripheral part 213*c* of the semi-conductor wafer 213, and reaction force of the peripheral part 213*c* receiving from the polishing cloth 211 becomes large, and an effect for furnishing the retainer ring 212 is not available. When the clearance C is small as shown in FIG. 22, the reaction force of the peripheral part 213*c* receiving from the polishing cloth 211 by the retainer ring 212 becomes small, and the effect for furnishing the retainer ring 212 can be sufficiently obtained.

Accordingly, if bringing the clearance to 0 unlimitedly, it is possible to obtain the retainer effect at the maximum, but actually it is difficult to process an inner diameter of the retainer ring equal to the diameter of the semiconductor wafer, taking dispersion of the diameter of the semi-conductor wafer and dispersion of the inner diameter of the retainer ring into consideration.

A method of checking face-sags in the wafer using the retainer ring is disclosed in JP-A-5-326468, and the disclosed polishing method carries out the polishing under a condition where the circumference of the wafer is attached with a ring of thickness smaller than a finished thickness of the wafer and checking the face sags.

But this disclosed method cannot bring the clearance to 0 unlimitedly, because the clearance is fixed during polish processing, and the retainer effect cannot be exhibited at the maximum.

Therefore, such a wafer polishing method has been demanded which can display the effect of the retainer ring to the most and prevent sags in the peripheral part of the wafer.

SUMMARY OF THE INVENTION

The invention has been realized to solve such problems, and it is an object of the invention to provide a polishing apparatus which polishes the semi-conductor wafers under a condition before recovering the polishing cloth (a deformed state), thereby to mirror-finish the semi-conductor wafers of flatness of high precision. It is another object of the invention to provide a polishing apparatus which prevents any invasion of excessive polishing liquid, easily controls a pressing force, has no probability of varying the pressing force, and is ready for being applied to such a polishing apparatus where a plurality of semi-conductor wafers are pasted on one sheet of plate for performing simultaneous polishings.

First, Inventors noticed properties of the polishing cloth for solving the problems.

Namely, when pressure to the polishing cloth is released, the polishing cloth gradually recovers an original state. Showing the relationship between pressure and displacing in FIG. 12, as apparently from this view, deformation of the polishing cloth 2 does not instantly recover the original state if removing pressure (load), but slowly recovers.

As is seen, the polishing cloth 2 is visco-elastic, and if it is pressed by the semi-conductor wafer to be polished, a so-called compression deformation is caused. Therefore, if pressing the semi-conductor wafer 5 to the polishing cloth 2 of the original state as shown in FIG. 13B, the semi-conductor wafer 5 sinks deeply in the polishing cloth 2 (the polishing cloth 2 is elastically deformed).

If the semi-conductor wafer 5 is polished under this condition, a down-part B of the polishing cloth 2 is large, and the circumferential part of the semi-conductor wafer 5 contacting the down-part B more advances the polishing than other parts, causing the so-called sags.

On the other hand, as seen in FIG. 13A, when the polishing cloth 2 is already elastically deformed and prior to recovering to the original state, the semi-conductor wafer sinks shallowly in the polishing cloth 2, and as the down-part B of the polishing cloth 2 is small, the sags are suppressed. Thus, based on this finding, the present invention has been established.

For accomplishing the above mentioned objects, the polishing apparatus of the invention is equipped with a polishing level block being rotatable and furnished with a polishing cloth for polishing semi-conductor wafers, a rotatable polishing head disposed in opposition to the polishing level block, and a polishing plate provided to the polishing head, said polishing plate being attached with a plurality of semi-conductor wafers, and a polishing operation being carried out as pressing said polishing cloth to said semi-conductor wafers, and is characterized by providing a guide ring disposed at the outside of the polishing plate for pressing the polishing cloth independently of polishing plate, a retainer ring provided at the lower end part of the guide ring for contacting to the polishing cloth, and a weight detachably mounted on the upper surface of the guide ring for adjusting pressure exerting on the polishing cloth.

As the polishing apparatus according to the invention detachably mounts weights on the upper surface of the guide ring, pressure of the retainer ring is easily controlled and has no probability of varying. Even in a case of the retainer ring having a large diameter as a batch type polishing apparatus for simultaneously polishing the plural semi-conductor wafers, substantially uniform pressure can be effected all over the retainer ring. Further, the retainer ring is provided at the lower end of the guide ring for contacting the polishing cloth, and therefore before the deformation of the polishing cloth recovers to the original shape (under the condition where the polishing cloth is already deformed), the semi-conductor wafers can be polished in mirror-finishing at high precision, enabling to avoid sags without equipping the retainer ring as encircling the outer circumference of each wafer.

The retainer ring is furnished for contacting the polishing cloth, so that the excessive polishing liquid is interrupted. Thus, the polishing liquid is not much supplied to the circumference of the semi-conductor wafer, enabling to prevent sags.

Herein, it is desirable to arrange an inside retainer for pressing the polishing cloth at the inside of the polishing plate.

Since the inside retainer is arranged inside of the polishing plate, elastic recovery at the inside of the polishing cloth is avoided, and prior to recovering the deformation of the polishing cloth (under the condition where the polishing cloth is already deformed), the polishing of the semi-conductor wafer is carried out. Therefore, it is possible to prevent collision between the semi-conductor wafer to be polished and the polishing cloth, enabling to prevent sags.

Herein, it is desirable that the inside retainer is composed of any of SiC and Al2O3.

Since the inside retainer is composed of any of SiC and Al2O3, it is excellent in abrasion resistance, enabling to avoid contamination of the semiconductor wafer to be polished.

In addition, it is desirable that the inside retainer is biased toward the polishing cloth by an elastic member, preferably, the inside retainer is provided at a front end of the holder to be biased by the elastic member.

Since the inside retainer is biased toward the polishing cloth by an elastic member, the pressure to the polishing cloth can be easily effected by changing the elastic member.

The weight is composed of plural ring-shaped weights each of which has a predetermined weight, and the pressure of the guide rings is desirably adjusted by selecting the ring shaped weights and mounting on the upper surface of the guide ring.

By combining the plural ring-shaped weights having the predetermined weight, specific pressing weight can be provided, so that the pressure of the retainer can be controlled.

It is desirable that the pressure of the retainer ring to the polishing cloth is around two to four times of the pressure of the semi-conductor wafer to the polishing cloth.

With this structure, the polishing cloth is pressed by the retainer ring, causing a sufficient compression deformation. Therefore before the deformation of the polishing cloth recovers to the original shape (under the condition where the polishing cloth is already deformed), the semi-conductor wafers can be polished. That is, the semi-conductor wafer to be polished does not sink in the polishing cloth, and is mirror-finished at high precision without causing avoid sags at the outer circumference of the wafer.

If the pressure of the retainer ring to the polishing cloth is below two times of the pressure of the semi-conductor wafer to the polishing cloth, since the polishing cloth does not cause the sufficient compression deformation, the deformation of the polishing cloth recovers to the original state before polishing the semi-conductor wafer, and the semi-conductor wafer sinks in the polishing cloth, causing avoid sags at the outer circumference of the wafer.

If the pressure of the retainer ring to the polishing cloth is beyond around four times of the pressure of the semi-conductor wafer to the polishing cloth, the polishing cloth causes a so-called plastic deformation, and the polishing cloth is undesirably not even in the surface.

It is desirable that that the retainer is a ceramic material composed of any of SiC and Al2O3.

As that the retainer is composed of any of SiC and Al2O3, it is excellent in abrasion resistance, enabling to avoid contamination of the semi-conductor wafer to be polished.

It is desirable that the holder and/or the guide ring are formed with PVC.

Neither holder nor guide ring require the abrasion resistance because of not contacting the polishing cloth, and it is desirable to employ resin materials such as PVC having rigidity and relatively light weight.

Further, it is also an object of the invention to provide a wafer polishing method which can display the effect of the retainer ring to the most and prevent sags in the peripheral part of the wafer.

According to this aspect of invention, a wafer polishing method is performed in the steps of dropping a slurry on a level block furnished with a polishing cloth thereon, pressing and rotating a wafer holding plate for polishing the wafers on the surface thereof, characterized by attaching retainer rings on the plate such that clearances are formed at peripheries of the wafers, and polishing the wafers as automatically adjusting the clearances.

Still further, a second aspect of the invention is such that the automatic adjustment is performed by pasting the retainer rings on the wafer holding plate making use surface tension of water.

DESCRIPTION OF THE PREFERRED EMBODIMENTS

Figure 1:
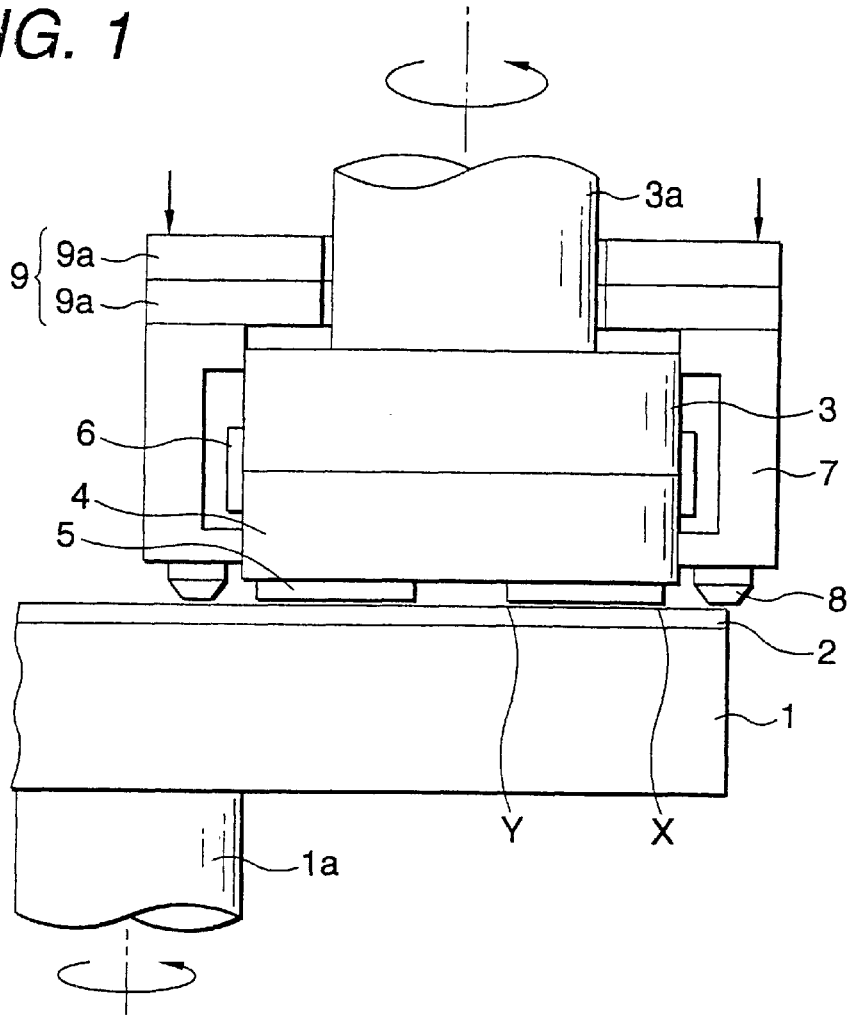
FIG. 1 is a vertically cross sectional view showing elementary parts of the polishing apparatus relating to a first embodiment of the invention.
Figure 2:
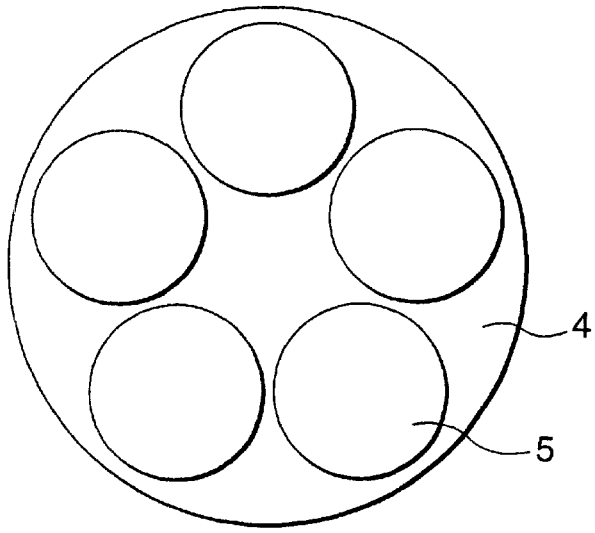
FIG. 2 is a view of the polishing plate of FIG. 1 seen at the lower part.
Figure 3:
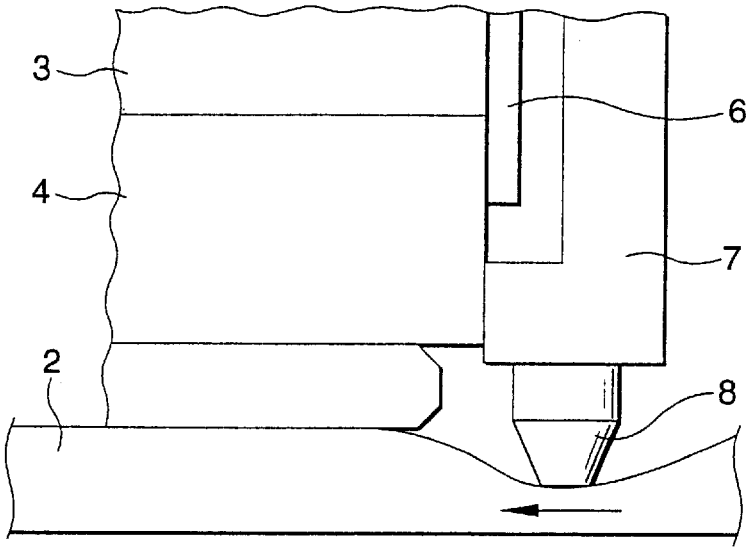
FIG. 3 is a cross sectional view of the elementary parts of FIG. 1 explaining that the polishing cloth is compression-deformed by the retainer ring.
Figure 4A:
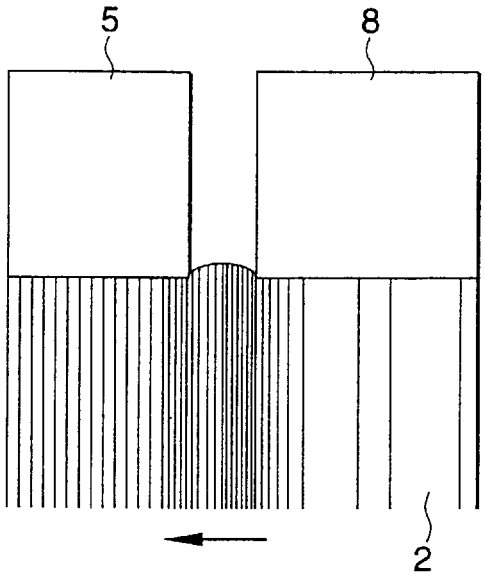
FIG. 4 is a schematic views showing the polishing cloth compression-deformed by pressure of the retainer ring and the semi-conductor wafer.
Figure 4B:
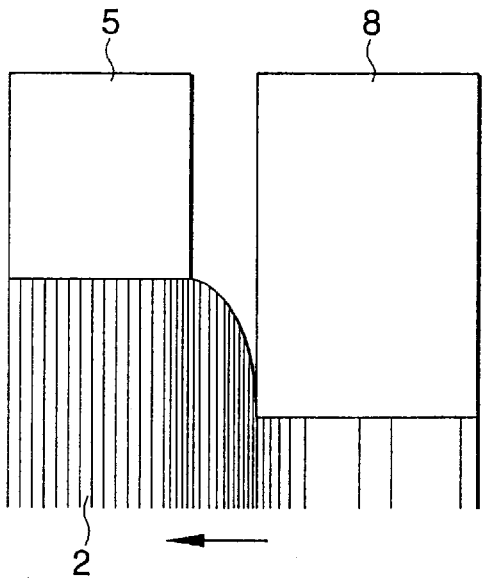
Figure 5:
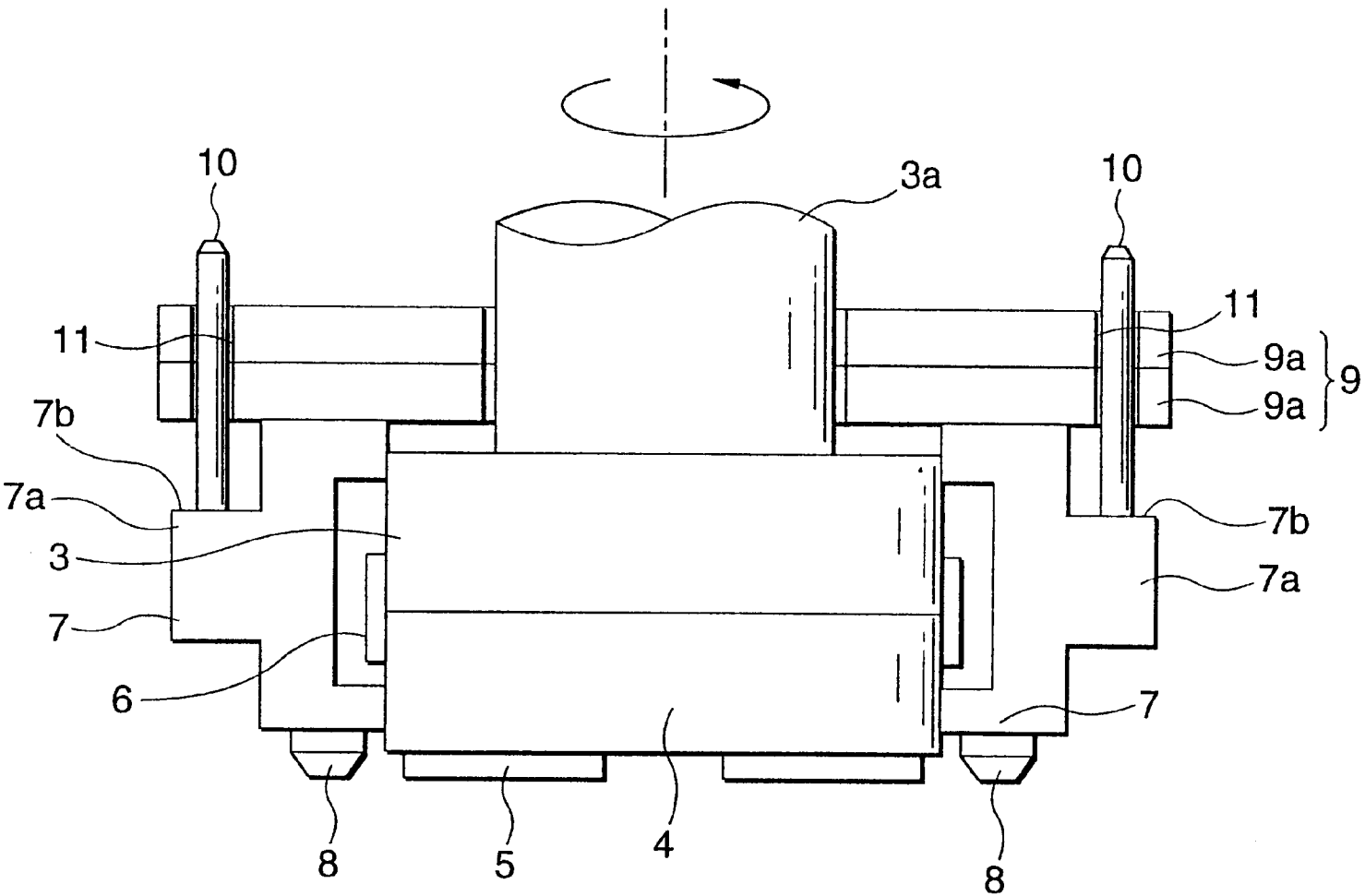
FIG. 5 is a cross sectional view showing a modified example of the polishing apparatus of the first embodiment shown in FIG. 1.

Further explanation will be made to a mode for reducing the polishing apparatus of the invention to practice in reference to the attached drawings. FIG. 1 is a vertically cross sectional view showing elementary parts of the polishing apparatus relating to a first embodiment of the invention, FIG. 2 is a view of the polishing plate seen at the lower part, FIG. 3 is a cross sectional view of the elementary parts showing that the polishing cloth is compression-deformed by the guide ring, FIG. 4 is schematic views showing the polishing cloth compression-deformed by pressure of the guide ring and the semi-conductor wafer, FIG. 5 is a cross sectional view showing a modified example of the first embodiment shown in FIG. 1, FIG. 6 is contour lines showing degrees of flatness of the polished wafers, and A is a case of presence of the guide ring, and B is a case of absence of the same.

As shown in FIG. 1, this polishing apparatus of the first embodiment of the invention is equipped with a rotary shaft 1*a*, a polishing level block 1 provided on the upper end of the rotary shaft 1*a*, a polishing cloth 2 pasted on the upper surface of the polishing level block 1, a polishing head 3 disposed rotatably and movably vertically at a position eccentric from the rotary shaft 1*a*, a plurality of plate holders 6 provided on the periphery of the polishing head 3, a polishing plate 4 attached to the lower surface of the polishing head 3 and to be positioned by the plate holder 6, a guide ring 7 disposed outside of the polishing head 3, a retainer ring 8 provided at the lower end of the guide ring for contacting the polishing cloth, and weights 9 mounted on the upper face of the guide ring 7.

The plurality of semi-conductor wafers 5 are, as shown in FIG. 1, disposed in the circumferential direction of the polishing plate 4 and are pasted on the surface of the polishing plate 4 by a wax.

The polishing apparatus of the first embodiment according to the invention is characterized, in comparison with the prior art polishing apparatus, by providing the guide ring 7 outside of the polishing head 3, the retainer ring 8 provided at the lower end of the guide ring 7 for contacting the polishing cloth, and the weight 9 mounted on the upper surface of the guide ring 7.

The guide ring 7 is cylindrical for receiving inside the polishing head 3 and is movable in the vertical directions independently of the guide ring 3. The guide ring is detachably attached at the front end Cower end portion) with the retainer ring 8 having a trapezoid shape in cross section. On the guide ring 7, the weight 9 is mounted for determining the pressure to the guide ring 7.

The polishing apparatus is structured such that the retainer ring 8 presses the polishing cloth 2 with predetermined force through the load of the weight 9 on the guide ring 9.

The weight 9 is composed of ring shaped weights 9*a* each of which has a predetermined weight, and one or plural ring shaped weights 9*a* are selected to mount on the guide ring 7 for setting the load of the guide ring 7. It is preferable that the ring shaped weights are determined in different weight. If combining the ring shaped weights of different weight, optimum load can be provided.

Since the weight 9 is mounted on the upper surface of the guide ring 7, the retainer ring 8 can obtain the pressure uniform all over the pressing face. The load to the guide ring 7 (retainer ring 8) by the weight 9 has no dangerous probability as changing as fluid pressure, so that a stable loading can be easily controlled. The load by the weight is suited to the polishing apparatus having the guide ring 7 (retainer ring 8) of large diameter encircling the plural sheets of the semi-conductor wafers 5.

The ring shaped weight 9 is half-divided (two-piece), and the ring shaped weights of a pair of half divided structure (two-piece structure) are combined from both sides as holding a rotary shaft 3*a* therebetween to be one body.

For acting the load of the weight 9 evenly on the guide ring 7, the center of the ring shaped weight 9*a* to be mounted should coincide with the center of the guide ring 7. For accomplishing this, as shown in FIG. 5, a step portion 7*b* is formed in the guide ring 7, bearing parts 7*a* are provided in plural places in the upper face of the step portion 7*b*, a positioning guide bar 10 is implanted in each of bearing part 7*a*, and a positioning hole 11 for inserting the positioning guide bar 10 is formed in the ring shaped weights 9.

By forming the positioning hole 11 for inserting the positioning bar 10 in the ring shaped weights 9*a* and exactly positioning the ring shaped weights 9*a*, the piled ring shaped weights 9*a* can be avoided from disorder of position and dropping.

It is desirable that the retainer ring 8 is formed toward the circumference of the semi-conductor wafer 5 as near as possible. Namely, the polishing cloth 2 compression-deformed by the retainer 8 provided nearly to the circumference of the semi-conductor wafer 5 performs the polishing of the semi-conductor wafer 5 before recovering to the original shape.

Practically, it is preferable the retainer ring 8 and the circumference of the semi-conductor wafer 5 are separate 5 to 20 mm.

Being less than 5 mm, the distance relative with the wafer is short and a structure of the apparatus is difficult. As the distance from the wafer is short, influence of pressing force of the retainer ring is ready for transmitting to the wafer, and a control of changing in the pressing force is sever. Being in excess of 20 mm, the compression-deformed polishing cloth by the retainer ring recovers to the original state, and this is not preferable.

As the polishing cloth 2 is compression-deformed by the retainer ring 8, the semi-conductor wafer can be polished under the condition where the semi-conductor wafer does not sink so much in the polishing cloth, and sags, can be avoided.

That is, when the polishing cloth 2 moves in an arrow direction shown in FIG. 3, the retainer ring 8 at the lower end of the guide ring 7 compression-deforms the polishing cloth 2. The polishing cloth 2 passing the retainer ring 8 elastically recovers (recovering from the deformed condition to the original condition), but a degree of the elastic recovery is weakened by the retainer ring 8 in the vicinity (near) of the polishing cloth, and even if being pressed by the semi-conductor wafer 5, the semi-conductor wafer 5 does not sink so much. As a result, the semi-conductor wafer can be polished under the condition before recovery of deformation of the polishing clothe 2.

Further explanation will be made to the deformed condition of the polishing cloth 2 effected by the pressure of the retainer ring 8 and the pressure of the semi-conductor wafer 5, referring to FIG. 4. As shown in FIG. 4A, if the pressure of the retainer ring 8 and that of the semi-conductor wafer 5 are almost equal, the polishing cloth 2 is compressed till the same height (depth), but between the retainer ring 8 and the semi-conductor wafer 5, the surface of the polishing cloth 2 becomes high owing to no load (the polishing cloth 2 at this part causes no deformation).

If the polishing cloth 2 is moved to the left under this condition, the right side circumference of the semi-conductor wafer 5 collides with the polishing cloth 2 in a range of no load, and sags are generated at the circumference of the semi-conductor wafer.

How the pressure of the retainer ring 8 is made more than the pressure of the semi-conductor wafer 5 must be determined taking materials of the polishing cloth 2, the distance between the retainer ring 8 and the semi-conductor wafer and other conditions into consideration.

For example, when the polishing cloth 2 is polyurethane of hardness (JIS-A) being 80 to 88, compressibility (JISL-1096) being 1.4 to 4.7%, thickness being 0.5 to 1.5 mm, and distance from the retainer ring 8 to the semi-conductor wafer being 5 to 20 mm, and if the strength of pressure of the retainer ring 8 is set to be around 2 to 4 times of that of the semi-conductor wafer 5, sags at the circumference of the semi-conductor wafer can be prevented.

If the pressure of the retainer ring 8 to the polishing cloth 2 is less than around 2 times of the pressure of the semi-conductor wafer 5 to the polishing cloth 2, the polishing cloth 2 does not cause sufficient compression- deformation.

Therefore, before polishing the semi-conductor wafer 5, the deformation of the polishing cloth 2 recovers and the semi-conductor wafer 5 sinks to cause sags at the outer circumference of the semi-conductor wafer 5. If the pressure of the retainer ring 8 to the polishing cloth 2 is more than around 4 times of the pressure of the semi-conductor wafer 5 to the polishing cloth 2, the polishing cloth 2 causes the plastic deformation, and undesirably the polishing cloth 2 is not even in the surface.

As there is provided the retainer ring 8 for contacting the polishing cloth, when dropping the polishing liquid A on the center of the polishing cloth 2, the excessive polishing liquid is interrupted and the polishing liquid of a proper amount is supplied to the semi-conductor wafer 5. As a result, the polishing at the circumferential part of the semi-conductor wafer 5 does not go ahead than that at the center part (inside part) but a uniform polishing is performed.

Figure 6A:
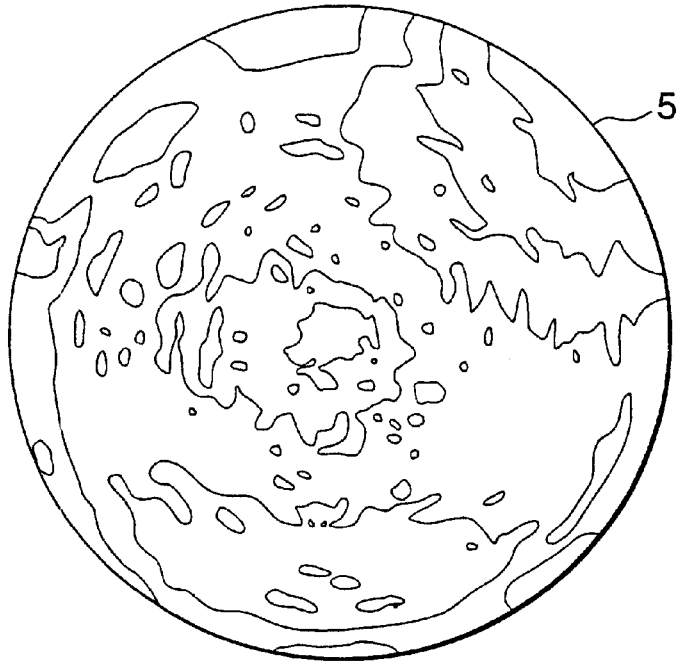
FIGS. 6A and 6B are views depicting contour lines showing degrees of flatness of the polished wafers.
Figure 10:
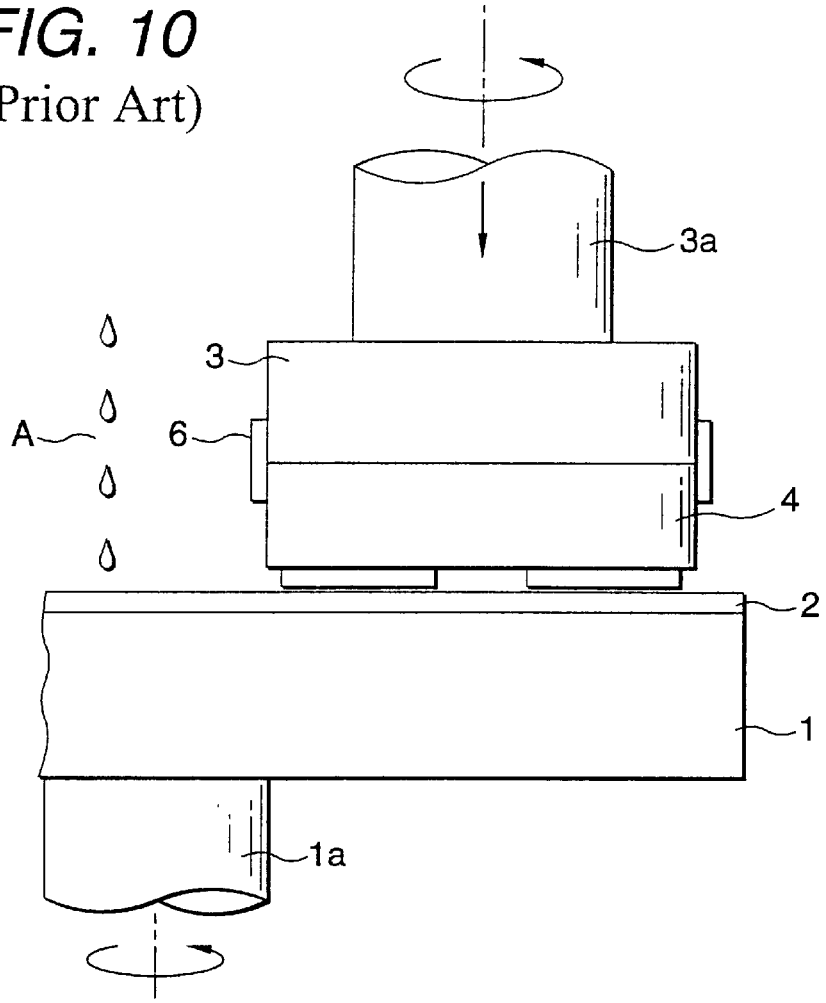
FIG. 10 (Prior Art)
FIG. 10 is a vertically cross sectional view of elementary parts showing a conventional polishing apparatus of the semi-conductor wafer.
Figure 11:
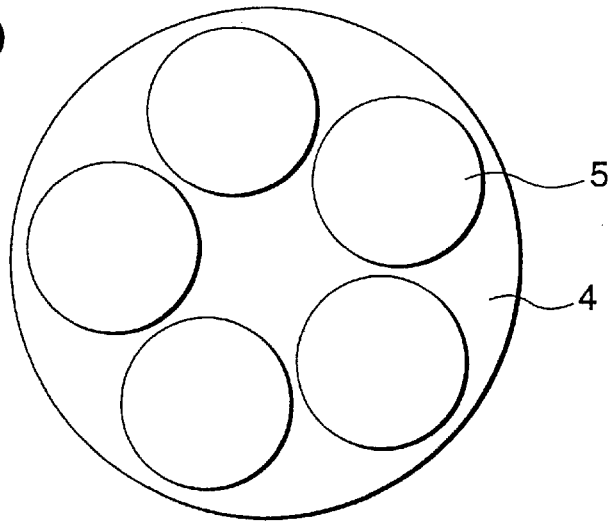
FIG. 11 (Prior Art)
FIG. 11 is a view of the polishing plate of FIG. 10 seen at the lower part.
Figure 12:
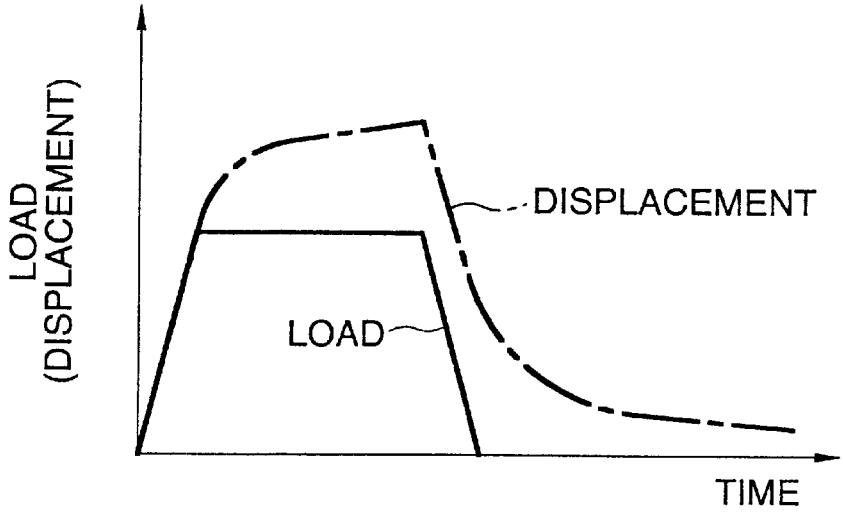
FIG. 12 is a view showing the load applied to the polishing cloth and the deformation amount thereof.
Figure 13A:
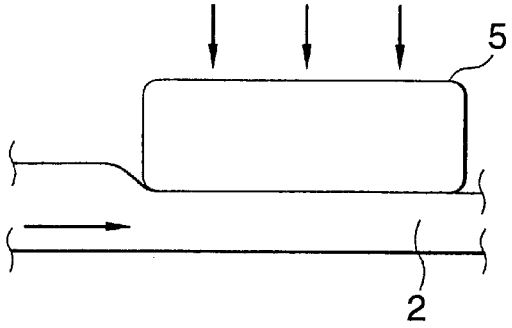
FIG. 13 is a schematic view for explaining occurrence of sags at the circumference of the semi-conductor wafer.
Figure 13B:
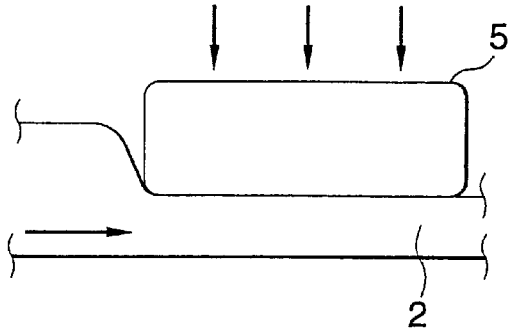

Using the polishing apparatus having the retainer ring 8 (the polishing apparatus shown in FIG. 5) and the polishing apparatus not having the retainer ring 8 (the conventional polishing apparatus shown in FIG. 10), the semi-conductor wafers 5 were actually polished for studying surface conditions. Results are shown in FIG. 6. FIG. 6 shows contour lines showing degrees of flatness of the polish-finished surfaces of the semi-conductor wafers 5, and FIG. 6A is a case of furnishing the retainer ring 8 and FIG. 6B is a case of not furnishing the retainer ring 8.

The polish-finishing conditions are preferably the surface pressure of the wafers being 80 to 250 g/cm$^2$, the pressure of the retainer being 200 to 1000 g/cm$^2$, the polishing level block being 20 to 50 rpm, and the polishing head being 15 to 30 rpm.

The tests were performed under the surface pressure being 110 g/cm$^2$, the pressure of the retainer ring being 350 g/cm$^2$, the polishing level block 30 rpm and the polishing head being 20 rpm.

Figure 6B:
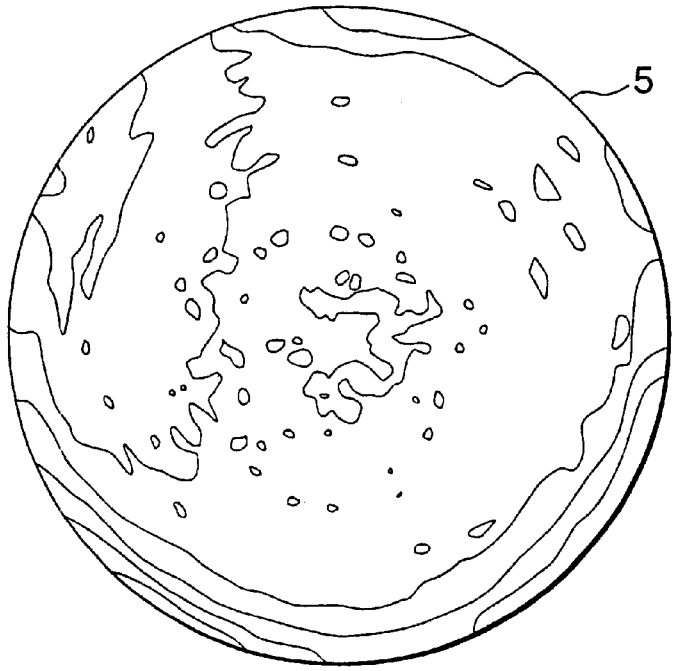

As apparently from the figures, in the surface of the semi-conductor wafer 5 of FIG. 6B, large sags are recognized. On the other hand, in the semi-conductor wafer 5 polished by the polishing apparatus furnished with the retainer ring 8, as seen in FIG. 6A, the polish-finished surface is even without sags.

Since the retainer ring 8 receives larger pressure than that of the semi-conductor wafer 5, the retainer ring 8 is also worn. Therefore, it is preferable to fabricate the retainer ring 8 with materials excellent in abrasion resistance, and specifically, it is good to employ ceramic materials such as SiC or Al2O3, thereby cause no contamination on the semi-conductor wafer.

Figure 7:
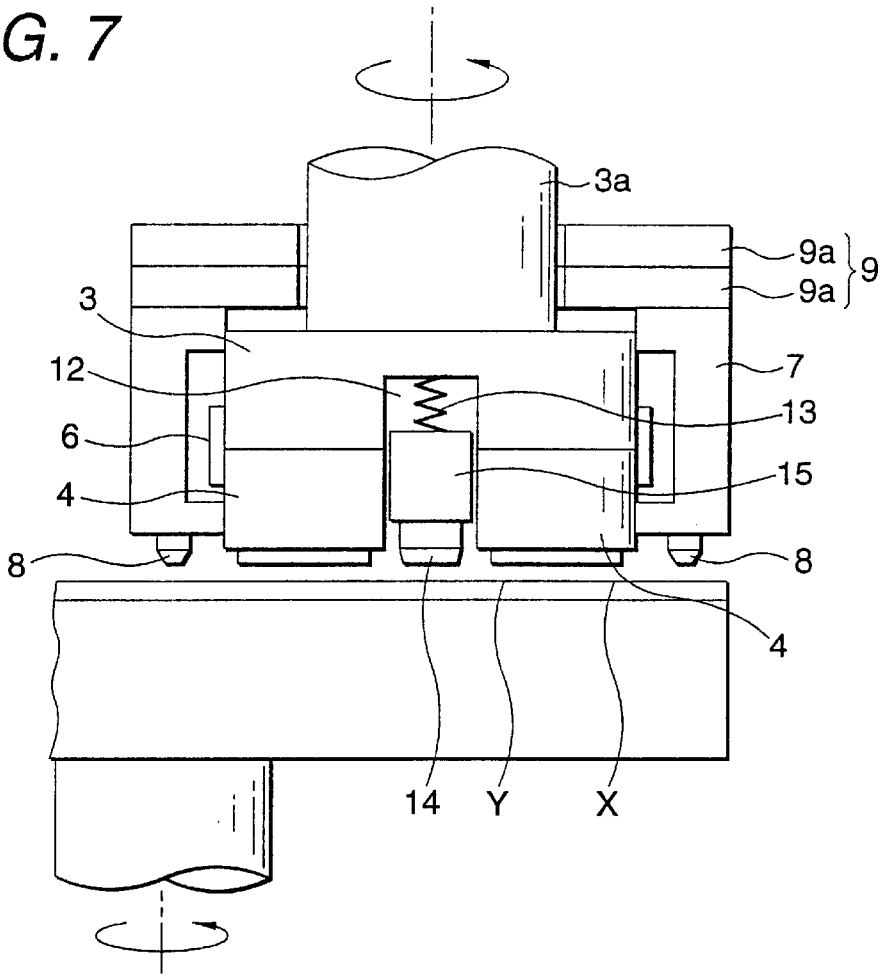
FIG. 7 is a vertically cross sectional view showing elementary parts of the polishing apparatus of the second embodiment according to the invention.
Figure 8:
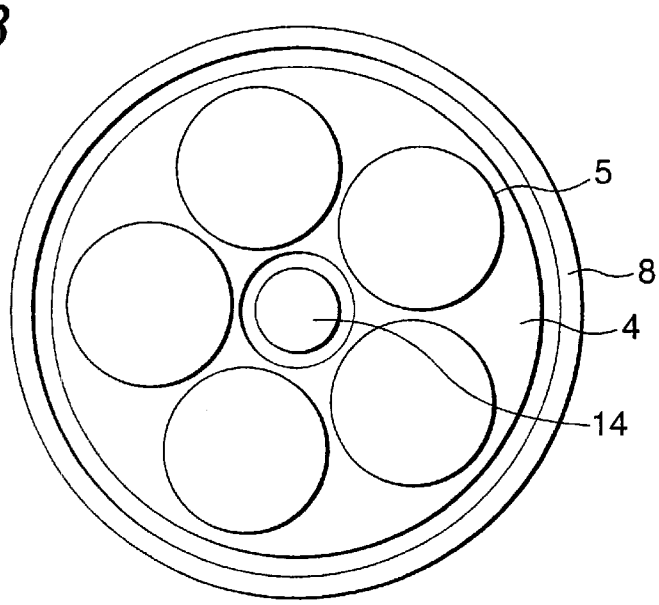
FIG. 8 is a view of the polishing plate of FIG. 7 seen at the lower part.
Figure 9:
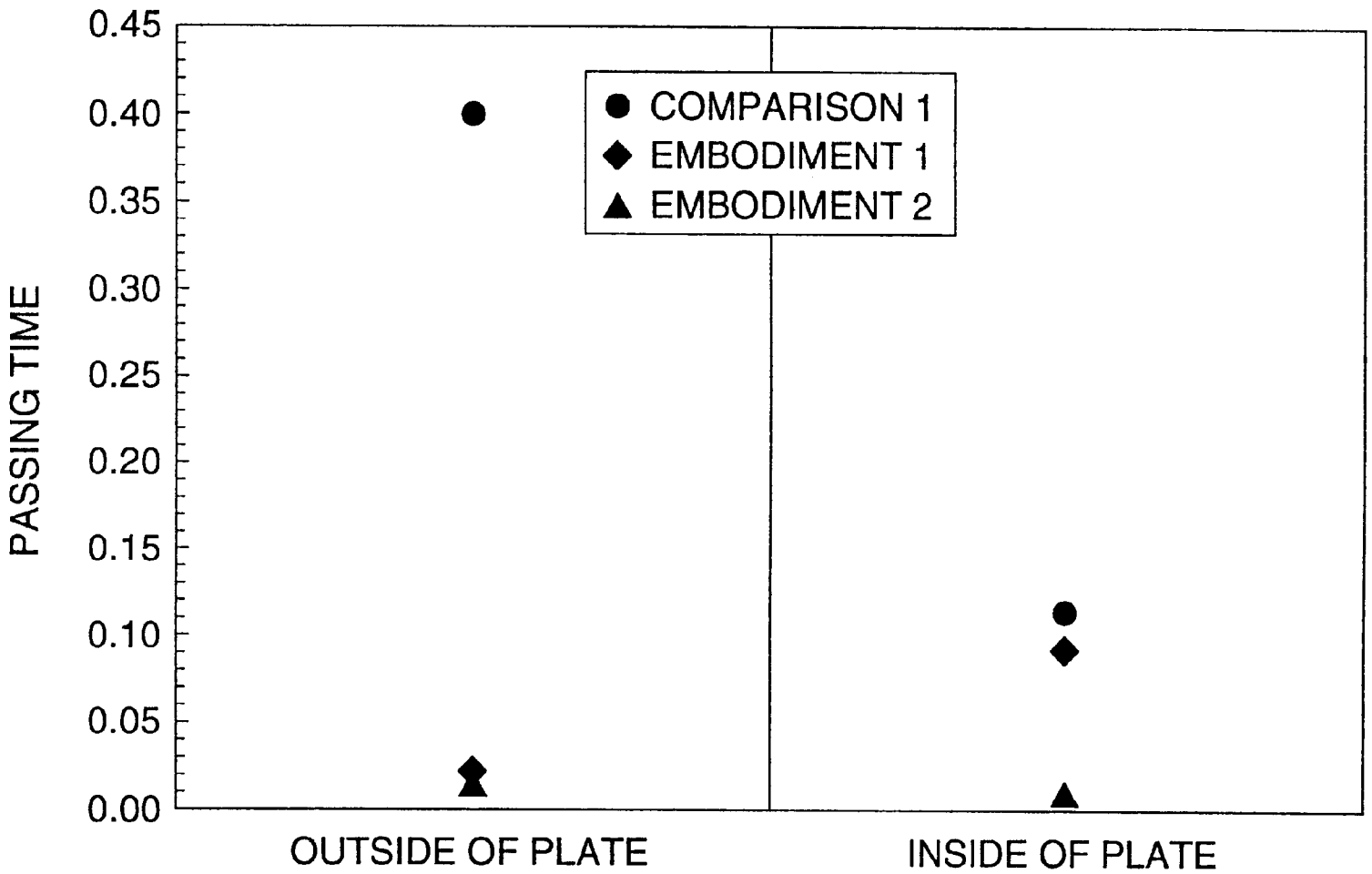
FIG. 9 is a view showing the passing time of the polishing clothe.

A second embodiment of the invention will be explained with reference to FIGS. 7 to 9. FIG. 7 is a vertically cross sectional view showing elementary parts of the polishing apparatus of the second embodiment according to the invention, and FIG. 8 is a view of the polishing plate seen at the lower part. The same or corresponding members shown in the first embodiment are given the same reference numeral and will not be explained in detail.

The polishing apparatus of the second embodiment is characterized, in comparison with the polishing apparatus of the first embodiment, by providing an inside retainer 14 as shown in FIG. 7.

That is, there is furnished a concave part 12 opening downward at the centers of the polishing head 3 and the polishing plate 4, and an elastic member (a coil spring in this embodiment) 13 is secured at its one end to the bottom of the concave part 12. The other end of the elastic member 13 is secured with a holder 15 holding the inside retainer 14. Also in this polishing apparatus of the second embodiment, similarly to the polishing apparatus of the first embodiment, the retainer ring 8 is provided.

The thus structured inside retainer 14 is biased in the direction pressing the polishing cloth 2, and similar working effect as the retainer ring 8 explained with respect to the first embodiment is displayed.

That is, when the inside retainer 14 is not furnished, as the plural wafers 5 are arranged in circumference on the surface of the polishing plate 4, parts not pressed by the semi-conductor wafer 5 are formed in the polishing cloth 2. In such parts the polishing cloth 2 elastically recovers and collides with the circumference of the semi-conductor wafer 5 to cause sags there.

On the other hand, if the inside retainer 14 is furnished, since the inside retainer ring 14 compression-deforms the polishing cloth 2 similarly to the retainer ring 8, the circumference of the semi-conductor wafer 5 does not collide with the polishing cloth 2, causing no sags at the circumference of the semi-conductor wafer 5. It is preferable to set the pressure of the inside retainer 14 to be larger than that of the semi-conductor wafer 5 similarly to the retainer 8.

It is desirable that the inside retainer ring 14 is near to the semiconductor wafer 5, and practically, it is preferable the retainer ring 14 and the semi-conductor wafer 5 are separate 5 to 20 mm as from the retainer ring 8 to the semi-conductor wafer 5.

Herein, the reason for setting 5 to 20 mm is because if being less than 5 mm, the distance relative with the wafer is short, and a structure of the apparatus is difficult. As the distance from the wafer is short, influence of pressing force of the retainer ring is ready for transmitting to the wafer, and a control of changing in the pressing force is severe. Being exceeding 20 mm, the compression-deformed polishing cloth by the retainer ring recovers to the original state, and this is not preferable.

As the materials of the inside retainer 14, the ceramic material such as SiC or Al2O3 having the abrasion resistance is used as the retainer 8.

Neither holder 15 nor guide ring 7 require the abrasion resistance because of not contacting the polishing cloth, and it is desirable to employ resin materials such as PVC having rigidity and relatively light weight. With respect to the first embodiment (Embodiment 1) furnished with the retainer ring 8, the second embodiment (Embodiment 2) furnished with the retainer ring 8 and the inside retainer 14, and the conventional polishing apparatus (Comparative Embodiment 1) furnished with none of them, the semi-conductor wafer or the retainer passed points of existence of the polishing cloth, and maximum values of time when the subsequent semi-conductor wafer or the retainer passed said points were investigated. The time is when no compression was effected to the polishing cloth. Results are shown in FIG. 9. The half of left in the same is the time when the polishing cloth passed outside of the polishing plate 4 (Point X in FIGS. 1 and 7), and the half of the right is the time when the polishing cloth passed inside of the plate (Point Y of FIGS. 1 and 7).

The conditions thereof are the diameter of the polishing level block being 1600 mm, the rotation speed being 40 rpm, the diameter of the polishing cloth being 1600 mm, the polishing plate being 590 mm, 5 sheets of semi-conductor wafers of 8 inches being pasted on the polishing plate, and the rotation speed of the polishing head being 20 rpm.

In the embodiment 1, the inner diameter of the retainer was 600 mm, and the retainer ring was positioned coaxially with the rotation center of the polishing plate.

Further, in the embodiment 2, other than the retainer ring of the embodiment 1, the inside retainer of the 140 mm diameter was positioned on the rotation central line of the polishing plate.

As shown in the same, the passing time (square mark) of the embodiment 1 and the passing time (triangle mark) of the embodiment 2 are shorter at the outside of the polishing plate in comparison with the passing time of the Comparative Embodiment (circle mark).

At the inside of the polishing plate, the passing time (circle mark) of the Comparative Embodiment 1 and that of the embodiment 1 are almost equal, but the passing time (triangle mark) of the embodiment 2 is shorter than them, showing a shortening effect of the passing time.

Accordingly, it is desirable that the polishing apparatus is equipped with not only the retainer ring but also the inside retainer ring for heightening the precision of flat degree of the semi-conductor wafer.

As the polishing apparatus of the invention is structured as mentioned above, the polishing can be performed under the condition before recovering the deformation of the polishing cloth, and the surface of the semi-conductor wafer can be finished at the flat surface of high precision.

As the excessive polishing liquid can be interrupted by the retainer ring, and at the same time the pressure of the polishing cloth is easily determined, and the determined pressure can be avoided from altering.

In addition, it is possible to add pressure uniform all over the retainer, and the surface of the semi-conductor wafer can be finished at the flat surface of high precision without causing any sags at the circumference of the semi-conductor wafer.

Figure 14:
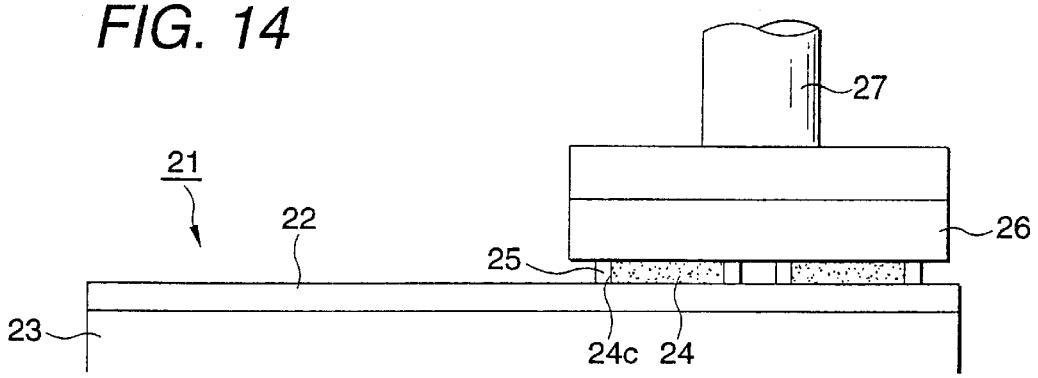
FIG. 14 is a side view of the polishing apparatus to be used to the wafer polishing method according to the invention.

As shown in FIG. 14, the polishing apparatus 21 to be served in the wafer polishing method of the invention comprises a level block 23 furnished with a polishing cloth 22 thereon and to be rotated, a polishing plate 26, and a rotating shaft 27 for rotating the polishing plate 26, said polishing plate 26 being fixedly pasted, via a wax, with the wafers, e.g., the semi-conductor wafers 24 pressed to the polishing cloth 22 and polished thereby and being pasted with the retainer rings 25 such that the clearances C are formed in relation with the semi-conductor wafers 24.

Figure 15:
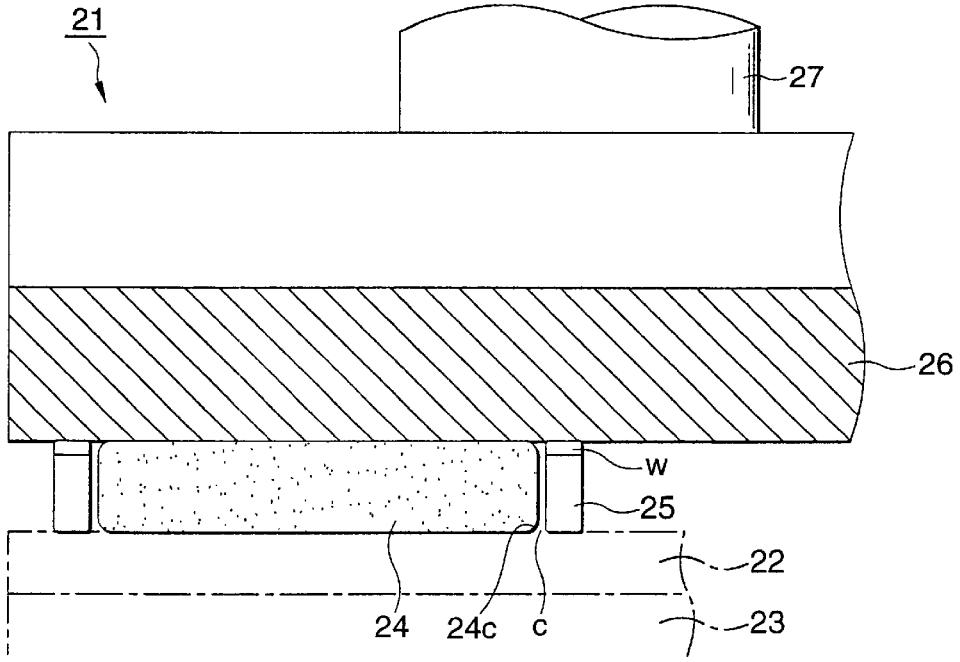
FIG. 15 is a side view of attaching the retainer ring apparatus to the polishing apparatus to be used to the wafer polishing method according to the invention.
Figure 16:
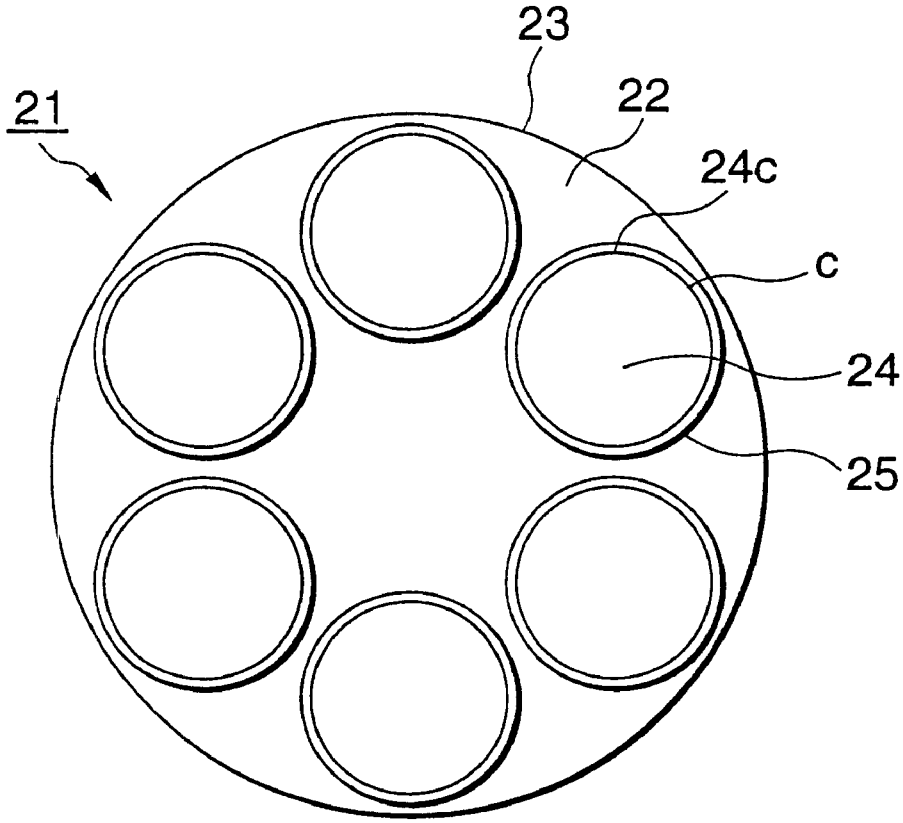
FIG. 16 is a plan view of the polish plate of the polishing apparatus to be used to the wafer method according to the invention.

Further, as shown in FIGS. 15 and 16, the retainer ring 25 is attached to the polishing plate 26 by using a water to form a water screen W so that a surface tension of the water screen W is utilized to be movable in relation with the retainer ring 25, and the clearance C formed between the peripheral part 24*c* of the semi-conductor wafer 24 and the retainer ring 25 can change its width by moving the retainer ring 25.

Further explanation will be made to a method for mirror-polishing the wafer according to the invention.

Figure 17A:
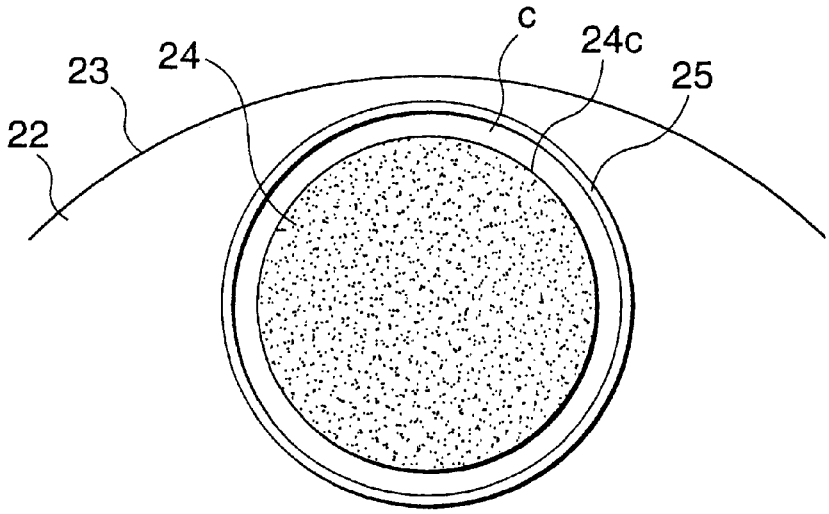
FIGS. 17A and 17B are enlarged views of elementary parts showing attachment of the retainer when starting the polishing in the wafer polishing method according the invention.
Figure 17B:
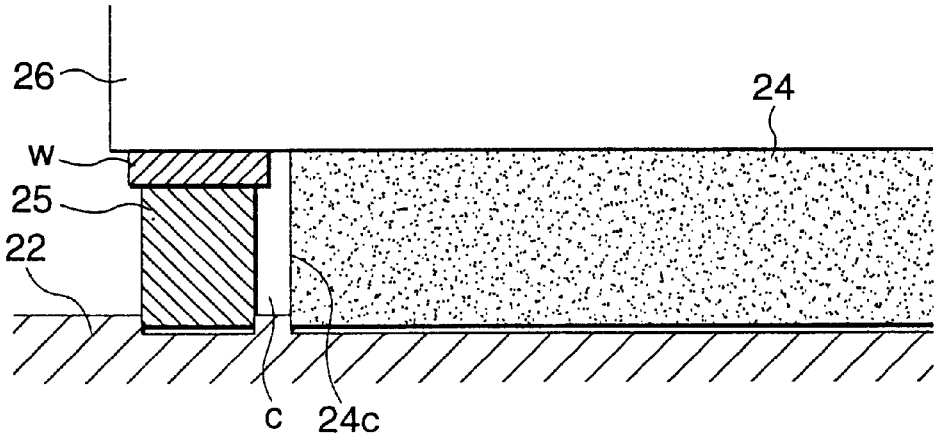

As shown in FIGS. 17A and 17B, the semi-conductor wafer 24 is fixedly held to the polishing plate 26 by a wax, and subsequently, the retainer ring 25 having an inner diameter somewhat larger than the diameter of the semi-conductor wafer 24 is attached to the polishing plate 26 by using a water to form a water screen W so that a surface tension of the water screen W is utilized. Under this condition, a slurry dispersed with silica is dropped on the level block 23 expanded with the polishing cloth 22, and the semi-conductor wafer 24 is polished on the surface by pressing and rotating the level block 23.

Figure 18A:
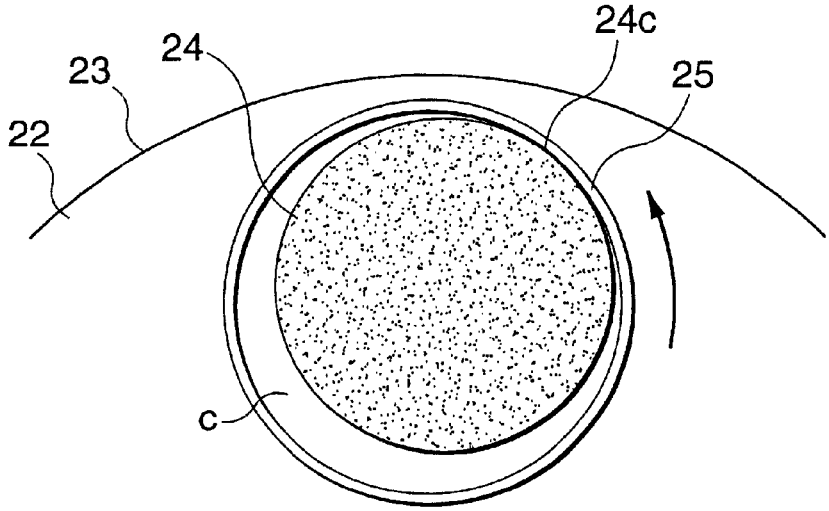
FIGS. 18A and 18B are enlarged views of elementary parts showing moving of the retainer ring when starting the polishing in the wafer polishing method according the invention.
Figure 18B:
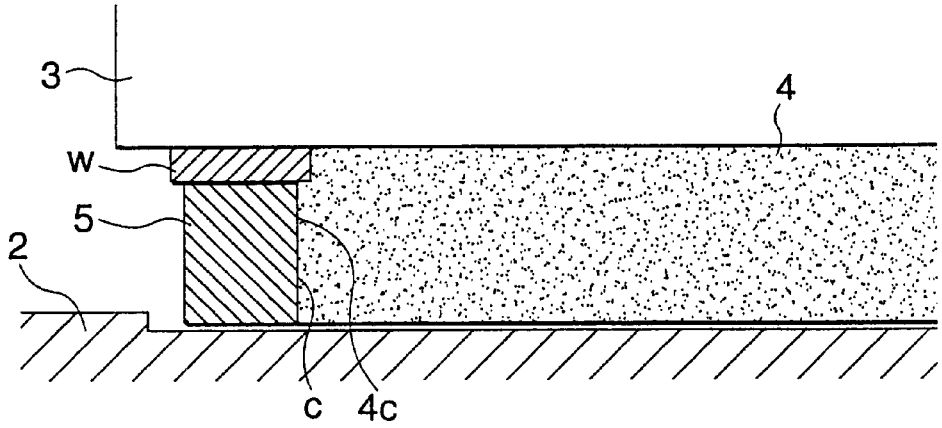

As shown in FIGS. 18A and 18B, in this polishing process, at an entering side of the polishing cloth 22 in the semi-conductor wafer 24, the retainer ring 25 is pasted by making use of the water surface tension, and as being movable (rotatably) in relation with the polishing plate 26 and not being fixed, the retainer ring 25 is pushed like being pushed by the polishing cloth 22 and contacted with the semi-conductor wafer 24. Thus, the clearance C between the retainer ring 25 and the peripheral part 24*c* of the semi-conductor wafer 24 approaches to 0 unlimitedly (until a beveling width), and the retainer effect can be obtained at the maximum, so that a large reaction force is not received at the peripheral part 24*c* of the semi-conductor wafer 24 from the polishing cloth 22, an excessive polishing can be prevented, and sags at the peripheral part 24*c* of the semi-conductor wafer 24 by the excessive polishing can be avoided.

In addition, it is not necessary to carry out a production by bringing the inner diameter of the retainer ring 25 nearly to the diameter of the semi-conductor wafer 24, and the production of the retainer ring 25 is easy, and it is easy to detach and attach the retainer ring 25.

The automatic adjustment of the clearance C during the polishing process is enabled by pasting the retainer ring 25 to the polishing plate 26 holding the semi-conductor wafer 24 through the water surface tension, without needing any special independent members or contaminating the semi-conductor wafer 24.

EXAMPLE (1) Purpose of test: To investigate conditions of sags at the peripheral part of the semi-conductor wafer polished by the wafer polishing method of the invention.

(2) Testing method: The semi-conductor wafer after chemical polishing is mirror-polished by the wafer polishing method according to the invention as shown in FIG. 16, and the thickness of the semi-conductor wafer is measured for making a contour line of the semi-conductor wafer. Also with respect to the semi-conductor wafer polished by the conventional mirror-polishing method, the contour line is made.

(3) Test results: Shown in FIG. 19 (Example) and FIG. 20 (Conventional example).

Figure 19:
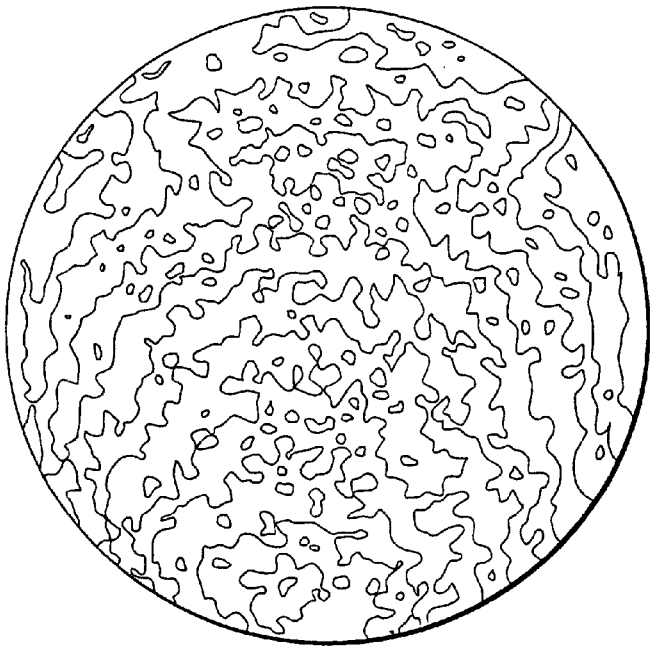
FIG. 19 is a contour line of the semi-conductor wafer polished by the wafer polishing method according to the invention.
Figure 20:
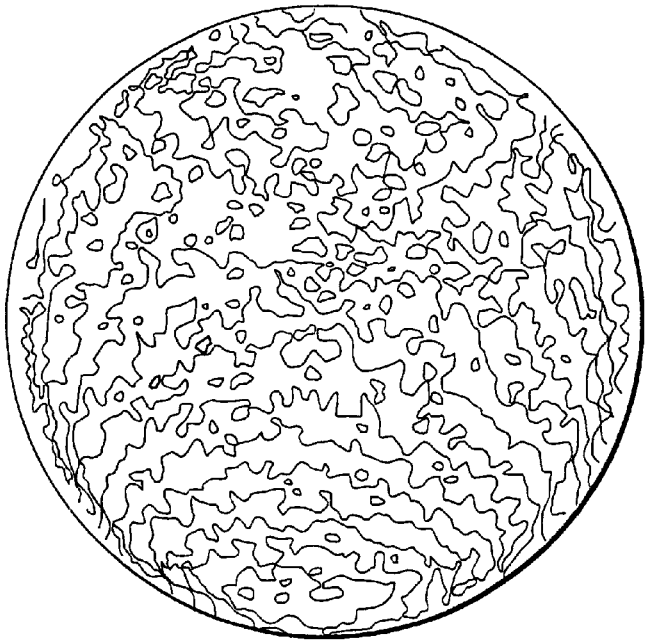
FIG. 20 is a contour line of the semi-conductor wafer polished by the wafer polishing method a according to the prior art.
Figure 21:
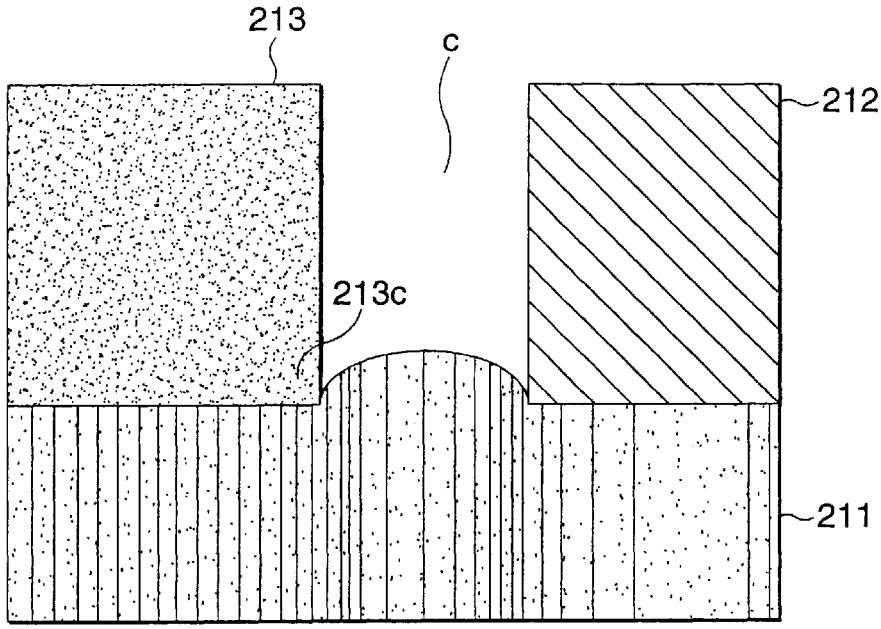
FIG. 21 is a result of simulating pressure dispersion of the polishing cloth occurring in the vicinity of the retainer ring by the static analysis (in the case of the large clearance)
Figure 22:
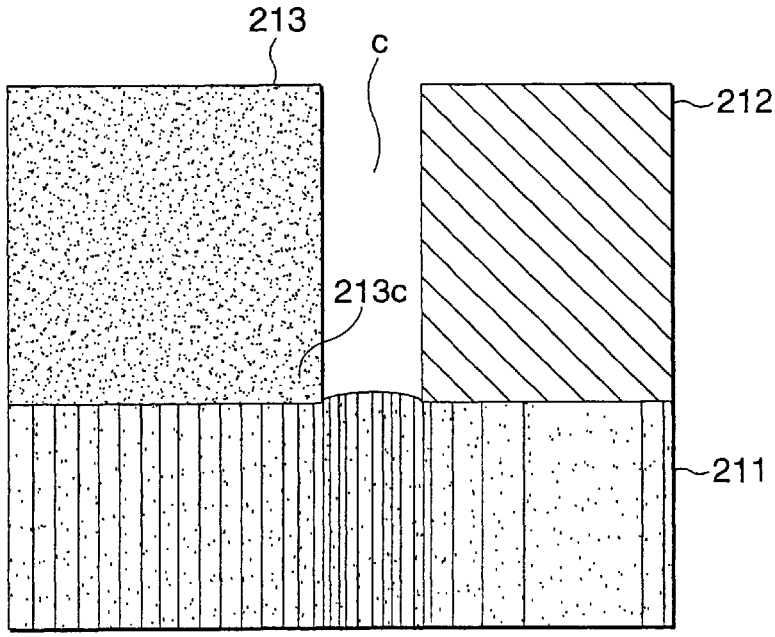
FIG. 22 is a result of simulating pressure dispersion of the polishing cloth occurring in the vicinity of the retainer ring by the static analysis (in the case of the small clearance).

As shown in FIG. 19, no sags appear at the peripheral part in the Example. On the other hand, as shown in FIG. 20, a sag range is seen at the peripheral part.

According to the wafer polishing method of the invention, it is possible to display the effect of the retainer ring to the most and prevent sags in the peripheral part of the wafer.

That is, by dropping a slurry on the level block furnished with the polishing cloth thereon, pressing and rotating the wafer holding plate, in the method of polishing the wafer on the surface, the retainer rings are attached on the plate such that clearances are defined at peripheries of the wafers, and the wafers are polished as automatically adjusting the clearances. Thus, the clearance C between the retainer ring and the peripheral part of the semi-conductor wafer approaches to 0 unlimitedly, and the effect of the retainer can be obtained at the maximum, so that as a large reaction force is not received at the peripheral part of the semi-conductor wafer from the polishing cloth, an excessive polishing can be prevented, and sags at the peripheral part of the semi-conductor wafer by the excessive polishing can be avoided. In addition, it is not necessary to carry out the production by bringing the inner diameter of the retainer ring nearly to the diameter of the semi-conductor wafer, and the production of the retainer ring is easy, and it is easy to detach and attach the retainer ring.

The automatic adjustment of the clearance C during the polishing process is enable by pasting the retainer ring to the polishing plate holding the semi-conductor wafer through the water surface tension, without needing any special independent members or contaminating the semi-conductor wafer.

What is claimed is:

1. A polishing apparatus equipped with a polishing level block being rotatable and furnished with a polishing cloth for polishing semi-conductor wafers, a rotatable polishing head disposed in opposition to the polishing level block, and a polishing plate provided to the polishing head, said polishing plate being attached with a plurality of semi-conductor wafers, and a polishing operation being carried out as pressing said polishing cloth to said semiconductor wafers, comprising:

a guide ring disposed at the outside of the polishing plate for pressing the polishing cloth independently of the polishing plate, a retainer ring provided at the lower end part of the guide ring for contacting to the polishing cloth, and a weight detachably mounted on the upper surface of the guide ring for adjusting pressure exerting on the polishing cloth, wherein the polishing plate is arranged inside with an inside retainer for pressing the polishing cloth.

2. A polishing apparatus as set forth in claim 1, wherein the inside retainer is composed of any of SiC and Al2O3.

3. A polishing apparatus as set forth in claim 1, wherein the inside retainer is biased toward the polishing cloth by an elastic material.

4. A polishing apparatus as set forth in claim 3, wherein the inside retainer is provided at a front end of the holder biased by the elastic material.

5. A polishing apparatus as set forth in claim 1, wherein the weight comprises of plural ring-shaped weights each of which has a predetermined weight, and the pressure of guide rings is adjusted by selecting the ring-shaped weights and mounting on the upper surface of the guide ring.

6. A polishing apparatus as set forth in claim 1, wherein the pressure of the retainer ring to the polishing cloth is around two to four times of the pressure of the semi-conductor wafer to the polishing cloth.

7. A polishing apparatus as set forth in claim 1, wherein the retainer comprises of any of SiC and $Al_2O_3$.

8. A polishing apparatus as set forth in claim 4, wherein the holder and/or the guide ring are formed with PVC (polyvinyl chloride).

* * * * *